US009668053B1

(12) United States Patent
Rivera et al.

(10) Patent No.: US 9,668,053 B1
(45) Date of Patent: May 30, 2017

(54) BLUETOOTH LANDSCAPE/PATHWAY LIGHTS

(71) Applicants: Chien Luen Industries Co., Ltd., Inc., Oakland Park, FL (US); DBEST Limited, Londo (GB)

(72) Inventors: Eliezer Rivera, Plantation, FL (US); Tien S. Lowe, Cooper City, FL (US); Jianwei Feng, Nanshan (CN)

(73) Assignees: Chien Luen Industries Co., Ltd., Inc., Oakland Park, FL (US); DBest Limited, London (GB)

( * ) Notice: Subject to any disclaimer, the term of this patent is extended or adjusted under 35 U.S.C. 154(b) by 73 days.

(21) Appl. No.: 14/204,756

(22) Filed: Mar. 11, 2014

Related U.S. Application Data

(60) Provisional application No. 61/777,512, filed on Mar. 12, 2013.

(51) Int. Cl.
*H04R 9/06* (2006.01)
*H04R 3/12* (2006.01)

(52) U.S. Cl.
CPC ..... *H04R 3/12* (2013.01)

(58) Field of Classification Search
USPC ..... 381/87, 124, 332, 333, 386, 388
See application file for complete search history.

(56) References Cited

U.S. PATENT DOCUMENTS 3,194,952 A 7/1965 Wells
6,249,091 B1 6/2001 Belliveau
6,331,756 B1 12/2001 Belliveau
6,483,470 B1 11/2002 Hohnstein
7,021,787 B1 * 4/2006 Kuelbs ..... A45B 3/04 362/183
7,309,965 B2 12/2007 Dowling
7,502,034 B2 3/2009 Chemel
7,630,776 B2 12/2009 Harwood
(Continued)

OTHER PUBLICATIONS

"Band I." Wikipedia. Aug. 15, 2012, https://en.wikipedia.org/wiki/Band_I.*

(Continued)

*Primary Examiner* — Joseph Saunders, Jr.
*Assistant Examiner* — James Mooney
(74) *Attorney, Agent, or Firm* — Brian S. Steinberger; Law Offices of Brian S. Steinberger, P.A.

(57) ABSTRACT

Audio landscape/pathway lights, devices, apparatus, systems and methods using BLUETOOTH wireless communication technology with integrated speakers, receivers/transmitters, outdoor speaker, PCB control card, driver, amplifier and FM receivers/transmitters. A single primary unit, which can be a pathway (landscape) light, can have a BLUETOOTH receiver and an FM transmitter, a speaker and a light (LED) and LED control. Secondary units can each contain a pathway/landscape light and FM receivers and speaker, and LED control. A Bluetooth enabled device from a portable digital device can send BLUETOOTH audio signals to the primary unit which automatically relays the audio signal to the secondary units so that the audio signal (music, words, and the like) can be synchronized and played simultaneously at all the units without lag time, echoes or reverberation, and without any other undesirable noise effects.

9 Claims, 11 Drawing Sheets

(56) References Cited

U.S. PATENT DOCUMENTS

| | | | | |
|---|---|---|---|---|
| 7,659,674 | B2 | 2/2010 | Mueller | |
| 7,817,063 | B2 | 10/2010 | Hawkins | |
| 8,010,319 | B2 | 8/2011 | Walters | |
| 8,042,961 | B2 | 10/2011 | Massara | |
| 8,090,453 | B1 | 1/2012 | Harwood | |
| D654,611 | S * | 2/2012 | Chen | D26/68 |
| D663,457 | S * | 7/2012 | Ho | D26/67 |
| 8,534,867 | B1 * | 9/2013 | Beadle | F21V 17/002 362/153.1 |
| 9,004,706 | B1 * | 4/2015 | Banfield | F21V 33/0056 362/86 |
| 2003/0127990 | A1 | 7/2003 | Weng | |
| 2004/0130909 | A1 | 7/2004 | Mueller | |
| 2005/0024857 | A1 * | 2/2005 | Vishwamitra | A63J 17/00 362/152 |
| 2006/0039570 | A1 | 2/2006 | Yeh | |
| 2006/0126860 | A1 * | 6/2006 | Sievers | F21V 21/0824 381/77 |
| 2006/0154598 | A1 | 7/2006 | Rudland | |
| 2009/0196016 | A1 * | 8/2009 | Massara | F21V 23/0471 362/86 |
| 2009/0207607 | A1 * | 8/2009 | Haase | F21K 9/13 362/234 |
| 2010/0215201 | A1 | 8/2010 | Kalomirakis | |
| 2011/0074266 | A1 * | 3/2011 | Sun | F21K 9/00 313/46 |
| 2012/0320572 | A1 * | 12/2012 | Fischer | F21V 19/002 362/183 |

OTHER PUBLICATIONS

"FM Broadcasting in Japan." Wikipedia Aug. 15 2012, https://en.wikipedia.org/wiki/FM_broadcasting_in_Japan.*

"American Starpower X2." NADY Systems. Sep. 14, 2004.*

* cited by examiner

BLUETOOTH LANDSCAPE/PATHWAY LIGHTS

CROSS REFERENCE TO RELATED APPLICATION

This application claims the benefit of priority to U.S. provisional patent application Ser. No. 61/777,512 filed Mar. 12, 2013, which is incorporated by reference in its' entirety.

FIELD OF INVENTION

This invention relates to lights, and in particular to audio landscape/pathway lights, devices, apparatus, systems and methods using BLUETOOTH wireless communication technology with integrated speakers, receivers/transmitters, outdoor speaker, PCB (printed circuit board) control card, driver, amplifier and FM (frequency modulated) receivers/transmitters.

BACKGROUND AND PRIOR ART

Staked lights are often used to light up a pathway or landscape to and from a residence, commercial building, and any other locations where lighting up a location is desired. Current techniques for providing traditional audio speakers with pathway/landscape lighting in order to generate music or messages and other audio effects at different locations has several problems.

For example, playing music or messages from plural speakers at various locations will often lag in time between the locations where sounds are not able to be played in unison causing undesirable and non-uniform playing of music, and/or other types of audio signals, such as messages, and the like.

Additionally, the audio sounds from the different speakers often lag will result in echo effects which are undesirable to persons walking in the vicinity of the different speakers along a pathway or landscape area.

Furthermore, the audio sounds from the different speakers often lag can result in reverberation and noise effects which are undesirable to persons walking in the vicinity of the different speakers along a pathway or landscape area.

BLUETOOTH is a wireless technology standard managed by the BLUETOOTH Special Interest Group, SIG. INC. Kirkland, Wash., for exchanging data over short distances (using short-wavelength radio transmissions in the ISM (Industrial, Scientific and Medical) band from 2400-2480 MHz) which has become popular to connect several devices such as portable devices and the like with one another, overcoming some problems of synchronization. However, the inventors are not aware of any devices, systems and the like, that have been able to apply BLUETOOTH to the speakers used in pathway/landscape lights.

Thus, the need exists for solutions to the above problems with the prior art.

SUMMARY OF THE INVENTION

A primary objective of the present invention is to provide audio landscape/pathway lights, devices, apparatus, systems and methods with BLUETOOTH wireless communication technology having integrated speakers, receivers/transmitters, outdoor speaker, PCB (printed circuit board) control card, driver, amplifier and FM (frequency modulated) receivers/transmitters A secondary objective of the present invention is to provide audio landscape/pathway lights, devices, apparatus, systems and methods where there is no lag time between playing music and audio signals between different units.

A third objective of the present invention is to provide audio landscape/pathway lights, devices, apparatus, systems and methods which eliminates echo effects when playing music and audio signals between different units.

A fourth objective of the present invention is to provide audio landscape/pathway lights, devices, apparatus, systems and methods which eliminates reverberation effects when playing music and audio signals between different units.

In a preferred embodiment, the main (master) unit having a light source, and slave (secondary) unit(s) each having light sources, receivers and speakers of the system can connected to a low voltage power supply such as a 12 volt power supply. Once the system is connected to the power supply, the system syncs itself. It syncs itself by the master unit sending a signal to the secondary units. Once this is completed, there is a Bluetooth tone to indicate the system is ready. This can happen within few seconds. A user can then connect to the system via Bluetooth connection. Once that connection is made, and audio send via the connection, can be disseminated to the secondary units via a FM frequency.

Further objects and advantages of this invention will be apparent from the following detailed description of the presently preferred embodiments which are illustrated schematically in the accompanying drawings.

DESCRIPTION OF THE PREFERRED EMBODIMENTS

Figure 1A:
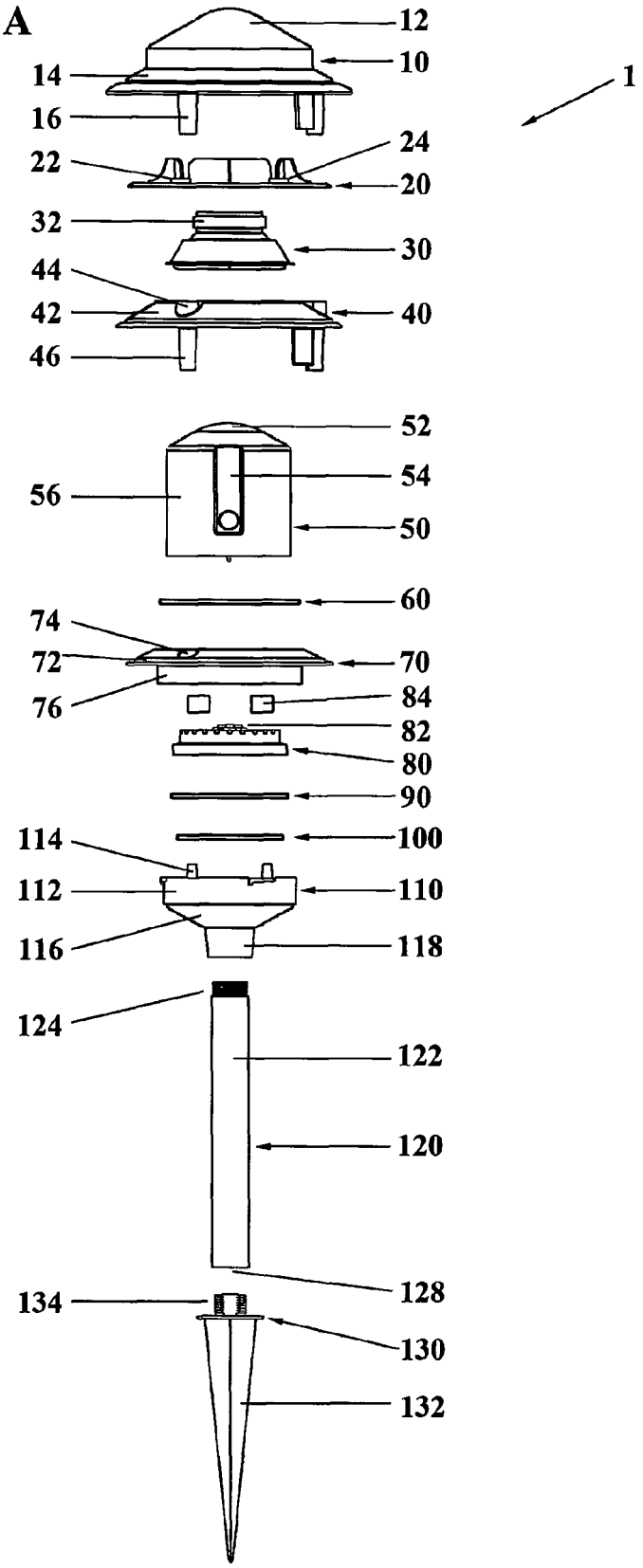
FIG. 1A is an exploded view of a preferred embodiment of a single pathway/landscape light with speaker that incorporates the BLUETOOTH technology.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components will now be described.

1 First embodiment landscape/pathway light
10. Top cover, formed from an injection molded plastic and the like, such as an ABS(acrylonitrile butadiene styrene) or metal such as but not limited to aluminum.
12. dome top
14. ring
16. downwardly protruding legs
20. inner cover
22. flat outer ring
24. upwardly curving members
30. speaker
30. speaker
32. base of speaker
30M. Main speaker
30S. Slave speaker
40. second tier cover
42. ring
44. slots for top cover legs
46. downwardly protruding legs
50. lens, such as plastic prismatic lens
52 dome portion
54 side groove(s) for legs 46
56 hollow cylindrical base of lens 50
60. water proof gasket
70. third tier cover
72. ring
74 slots for $2^{nd}$ tier cover legs
76. cylindrical base
80. heat sink
82. light source, such as but not limited to LED (light emitting diode), pin based bulb
84 fasteners, such as nuts, and the like.
90. printed circuit board
100. water proof gasket
110. bottom cover
112. cylindrical base
114. upwardly protruding fastener
116. inwardly tapering portion
118. lower female connector/socket end with internal threads
120. post
122. cylindrical elongated post section
124. upper male member end with exterior threads
128. lower female connector/socket end with internal threads
130. stake
132. lower spike end
134. upper male member end with exterior threads
140. low voltage wire connector
150. connector KTE-851
160M. Main transformer low voltage converts 120 volt AC to 12 volt DC.
170M. Main LDO series, includes plural low-dropout regulators, such as DC linear voltage regulators, which drops down power.
172M. LDO (low-dropout linear voltage regulator)
174M. LDO (low-dropout linear voltage regulator)
176M. LDO (low-dropout linear voltage regulator)
182M. Main LED (light emitting diode) light, as the light source.
184M. Main MCU (micro controller unit) chip, multi-point control unit for bridging connection between antenna 192 and FM transmitter 190.
186M. Main BLUETOOTH, such as a 3.2 BLUETOOTH (operates at 2,400 GHz)
188M. Main AMP, such as an audio amplifier
190. Main FM Transmitter, such as a FM car transmitter for a smart device or audio output.
192, Main Antenna
160S. Slave AC/DC, (same transformer 160M connected in series to main transformer 160M, OR alternatively this is a separate transformer low voltage converts 120 volt AC to 12 volt DC)
170S. Slave LDO series, includes plural low-dropout regulators, such as DC linear voltage regulators, which drops down power.
172S. LDO (low-dropout linear voltage regulator)
174S. LDO (low-dropout linear voltage regulator)
182S. Slave LED (light emitting diode) light, as the light source
184S. Slave MCU, (micro controller unit) chip, multi-point control unit for bridging connection between antenna 196 and FM receiver 194.
188S. Slave AMP, such as but not limited to a car amplifier
194. Slave FM Receiver
196, Slave Antenna,
200. Second embodiment landscape light
210. Top cover, formed from an injection molded plastic and the like, such as an ABS(acrylonitrile butadiene styrene) or metal such as but not limited to aluminum.
220. inner cover
230. speaker
240. second tier cover
250. lens, such as plastic prismatic lens
260. water proof gasket
270. third tier cover
280. heat sink with LED
290. printed circuit board
300. water proof gasket
310. bottom cover
320. post
330. stake The invention can work with a main (primary) pathway/landscape light with speaker connected in series with speakers in slave (secondary) pathway/landscape light(s). Both the main pathway/landscape light and slave pathway/landscape light can be assembled and have similar basic exterior structural components that can be easily assembled together. A whole audio lights system contains a main primary unit and at least one slave unit(s). The main unit can contain BLUETOOTH signal receive module, amplifier, FM sender, Led control unit. Each slave unit can have a FM receive module, amplifier and LED control unit.

Figure 1D:
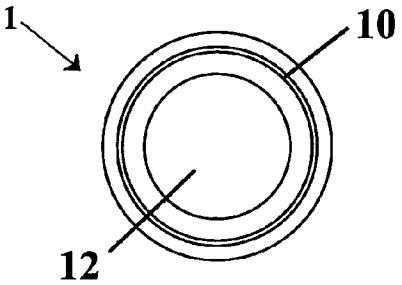
FIG. 1D is a top view of the assembled pathway/landscape light with speaker of FIG. 1B.
Figure 1C:
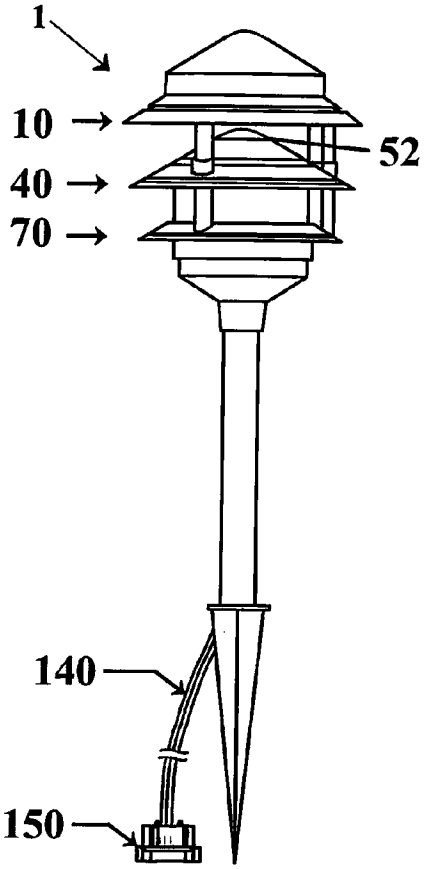
FIG. 1C is a front view of the assembled pathway/landscape light with speaker of FIG. 1B.
Figure 1B:
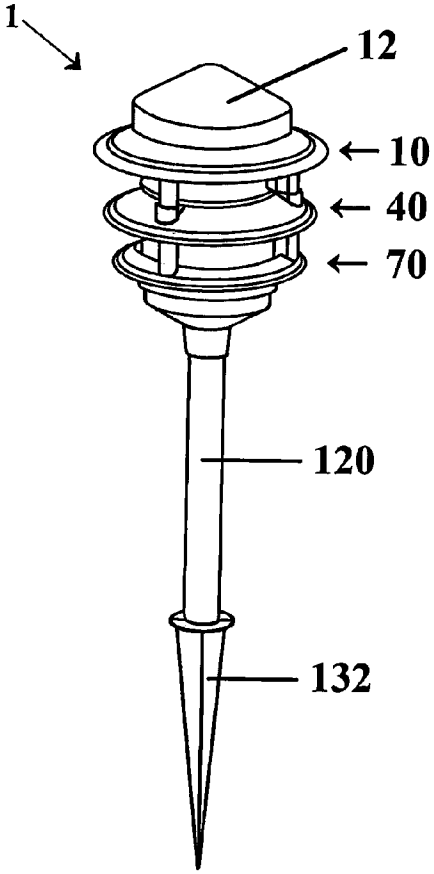
FIG. 1B is an assembled perspective view of the pathway/landscape light of FIG. 1A.

FIG. 1A is an exploded view of a preferred embodiment of a single pathway/landscape light 1 with speaker 30 that incorporates the BLUETOOTH technology. FIG. 1B is an assembled perspective view of the pathway/landscape light 1 of FIG. 1A. FIG. 1C is a front view of the assembled pathway/landscape light 1 with speaker 30 of FIG. 1B. FIG. 1D is a top view of the assembled pathway/landscape light 1 with speaker 30 of FIG. 1B.

Figure 2:
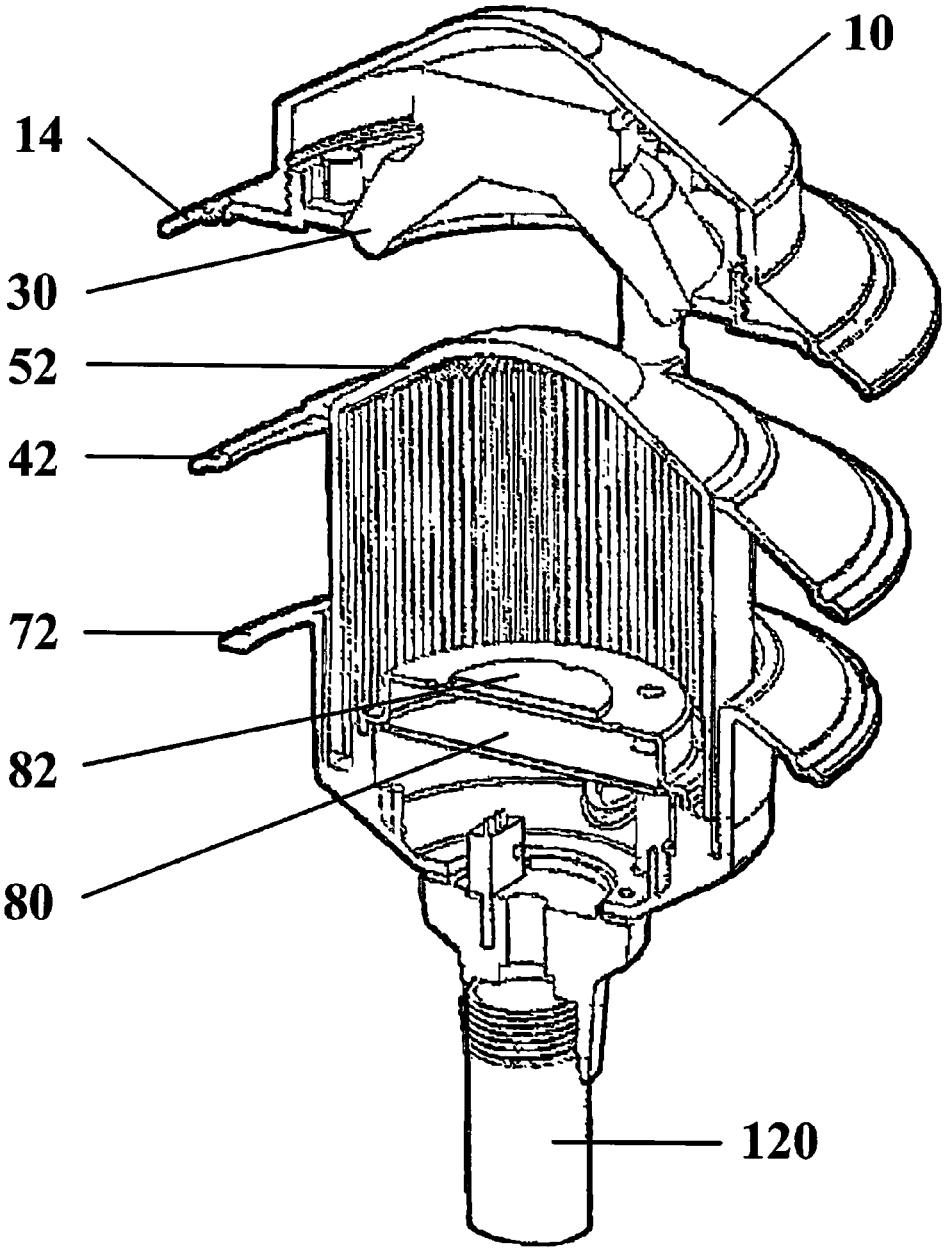
FIG. 2 shows a cross-sectional and partially assembled view of pathway/landscape light of FIGS. 1A-1D.
Figure 3:
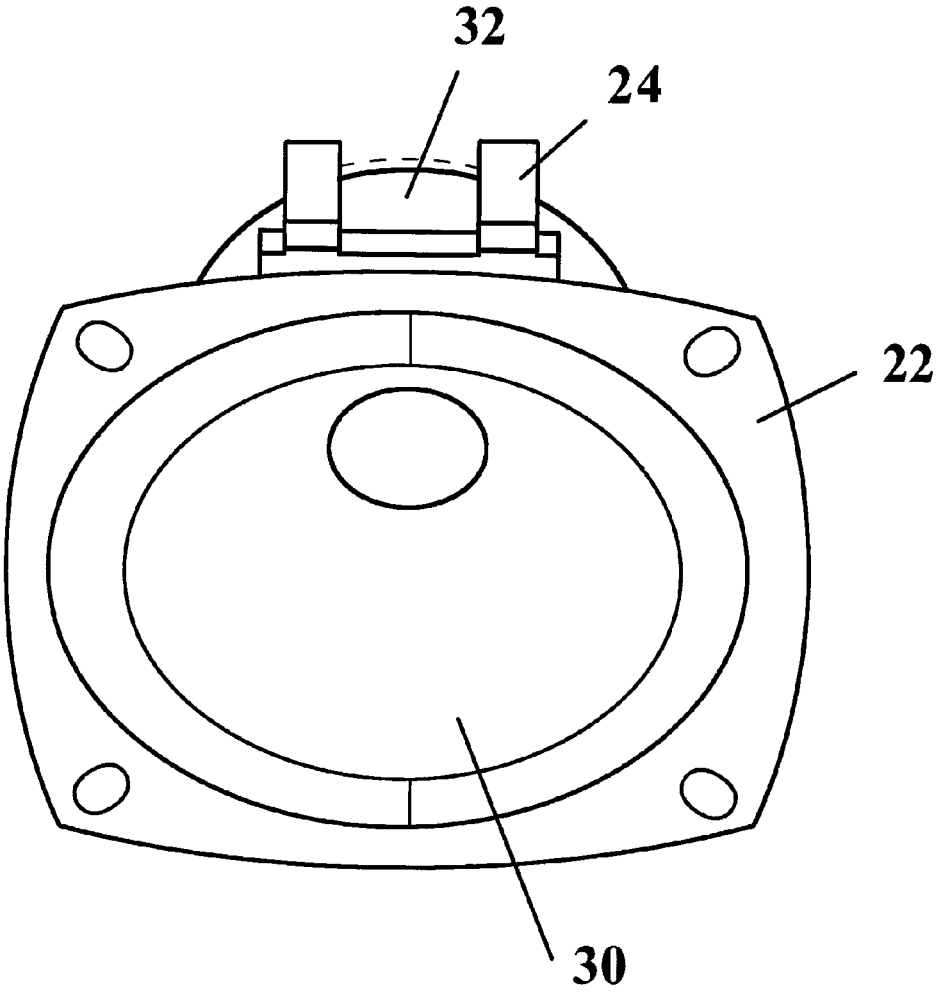
FIG. 3 shows the speaker mounted within the inner cover of the pathway/landscape light of FIGS. 1A-2.

FIG. 2 shows a cross-sectional and partially assembled view of pathway/landscape light 1 of FIGS. 1A-1D. FIG. 2 shows a light source 82 and heat sink 80 circuit unit for use with the pathway/landscape light 1 of FIGS. 1A-1D. This unit is a part of the audio lights system which contains the Speaker 30. FIG. 3 shows the speaker 30 mounted within the inner cover 22 of the pathway/landscape light of FIGS. 1A-2.

Referring to FIG. 1A-1D, each piece can be assembled together using screws or twist lock connections. The upper male member end 134 of lower spike 132 inserts into lower female connector/socket end 128 of post 120 by threadably screwing parts together or by compression fit, and the like. The exterior surface 122 of the post 120 can be any geometric shape, such as but not limited to cylindrical, rectangular, and the like, the purpose of which is to extend the light source 82 over the ground engaging lower spike end 132 which inserts into the ground when the main/slave unit 1 is installed.

Upper male member end 124 of post 120 inserts into and attaches into lower female connector/socket 118 of bottom cover 110 by threadably screwing parts together or by compression fit, and the like. Female connector/socket 118 and inwardly tapering portion 116 and cylindrical base 112 forms a single bottom cover 110 Extending upward from cylindrical base 112 can be a pair of upwardly protruding posts 114, which can have threaded tips Gasket 100, such as but not limited to an elastomer or rubber type O-ring can be placed inside or on the upper perimeter edges of cylindrical base 112 of the bottom cover 110. The PCB (printed circuit board) 90 (FIG. 6 for main unit, or FIG. 7 for slave unit) can be sandwiched between the bottom of heat sink 80 and PCB 90. Heat sink 80 can include but is not limited to a aluminum, having a disc (coin shaped) base with an upper top fin section having longitudinal surface grooves on top for allowing air to cool the surface mounted light source 82, which can be held on top of the heat sink 80 by screws or thermal type paste. Light source 82 is electrically attached to heat sink 80 which is electrically attached to PCB 90. Two vertical through-holes in the heat sink 80 allow for the posts 114 to pass therethrough, with fasteners 84, such as but not limited to nuts, and the like, hold heat sink 80 to the bottom cover 110.

Cylindrical base 76 of $3^{rd}$ tier cover 70 can fasten over and to cylindrical base 112 of the bottom cover 110 by twist lock, threaded connections, or fastened by screws, and the like. A sideways extending decorative ring 72 can extend sideways from $3^{rd}$ tier cover 70. Upper surface slots 47 in the ring 72 can be used for mounting bottom ends of downwardly protruding legs 46 therein. Another ring shaped gasket 60 can sit on top of the upper step edge of ring 72. Lens 50 can cylindrical shaped prismatic lens having an upper dome portion 54 and vertical side groove(s) 54 which allow for legs 46 to be positioned within when the hollow cylindrical base 56 of lens 50, slides into the cylindrical open top of $3^{rd}$ tier 70 and covers the heat skink 80 and sits within the upper opening of the cylindrical base 112 of the bottom cover 110. FIG. 2 shows the light source 82 on top of heat sink 80 within the $3^{rd}$ tier cover 70.

Referring to FIG. 1A, the dome portion 52 of the lens 50 protrudes through the open cylindrical portion of the $2^{nd}$ tier cover 40 (as shown in FIG. 1C). A sideways extending decorative ring 42 can extend sideways from $2^{nd}$ tier cover 40. Upper surface slots 44 in ring 42 allow for mounting the bottom of downwardly protruding legs 16 in.

The base 32 of the speaker 30 fits into an opening formed between curving members 24. FIG. 3 shows an upside down view of the speaker 30 with base 32 mounted into the opening in the outer ring 22 of the inner cover 20. A side view in FIG. 1C shows the speaker 30 not visible since it is within top cover 10. The top cover 10 can have a dome shaped top 12, and a decorative ring 14 extending sideways outwardly from the top cover 10, and a hollow opening in the bottom of top cover 10. The curving members 24 fits into the opening in the bottom of top cover 10, and can be held in place by fasteners, such as screws, clips, and the like.

Figure 4:
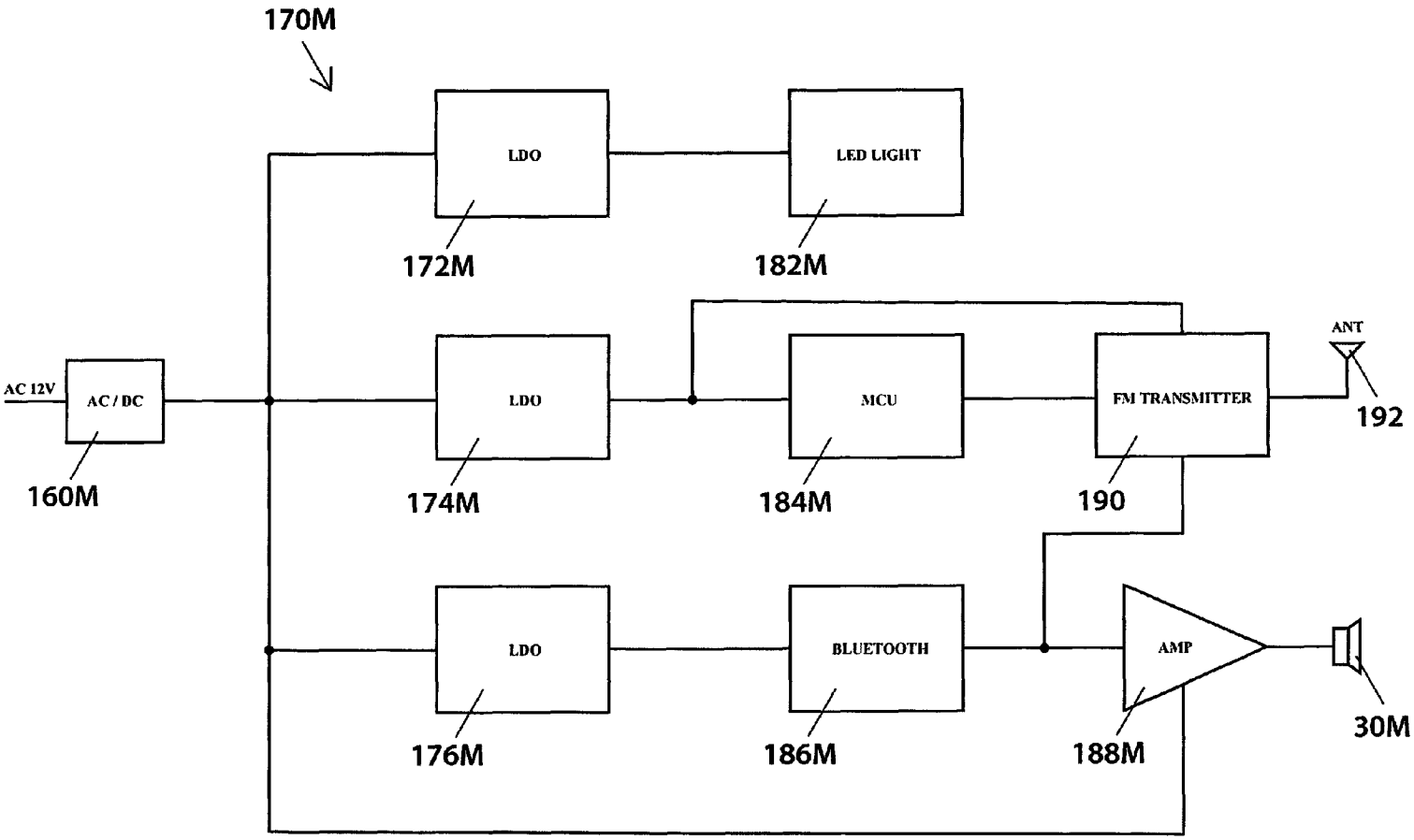
FIG. 4 is an audio light main speaker block diagram.

FIG. 4 shows a main (primary unit) audio light speaker block diagram. The primary unit operates the amplifier, the BLUETOOTH and operates the FM transmitter and controls LED lights only in the primary. The primary unit controls the audio of the secondary units through the FM transmitters. A single 12V transformer provides power to the primary and secondary units.

Referring to FIGS. 1A-4, the primary (main) unit can include a main speaker 30M having the following specifications.

Main Speaker Specifications Include
Device Name: Path Light+4 Digit SN
BLUETOOTH Protocol: V3.0+EDR
BLUETOOTH Transmission Distance: ≥10 M
BLUETOOTH Auto Re-connect Time Limit: Within 30 Mins.
Driver Rating Power: 5 W
Max Power of Main Speaker Unit: 10 W (Includes Led)
Speaker Frequency Response: 150 Hz~20 KHz
FM Frequency: 76.5 Mhz~83.2 Mhz (4 Channels Switch Automatically)
FM Distance: ≥10 M
FM Power: ≤20 mW
Search Slave Speakers Time Limit: Within 5 Mins.
LED: 2*0.25 W
LED Light Temp: 100 Lm/W 3000K
LED Lumen ≤1 Lm (Lux) On
LED Lumen ≥20 Lm (Lux) Off Referring to FIGS. 1-4, a power source of 12V into the circuit can be stepped down to a lower voltage for the smaller components to avoid damage to those components. The four components are a LED (light emitting diode), a MCU (micro controller unit chip), and BLUETOOTH transmitter.

The LED is a light source for the landscape light in order to illuminate a desired area. The MCU, controls the FM transmitter The BLUETOOTH transmitter allows for a wireless connection between a smart device with BLUETOOTH and receive audio signals to push it out through the FM transmitter. The FM transmitter can send out a signal that a FM receiver can receive.

Figure 5:
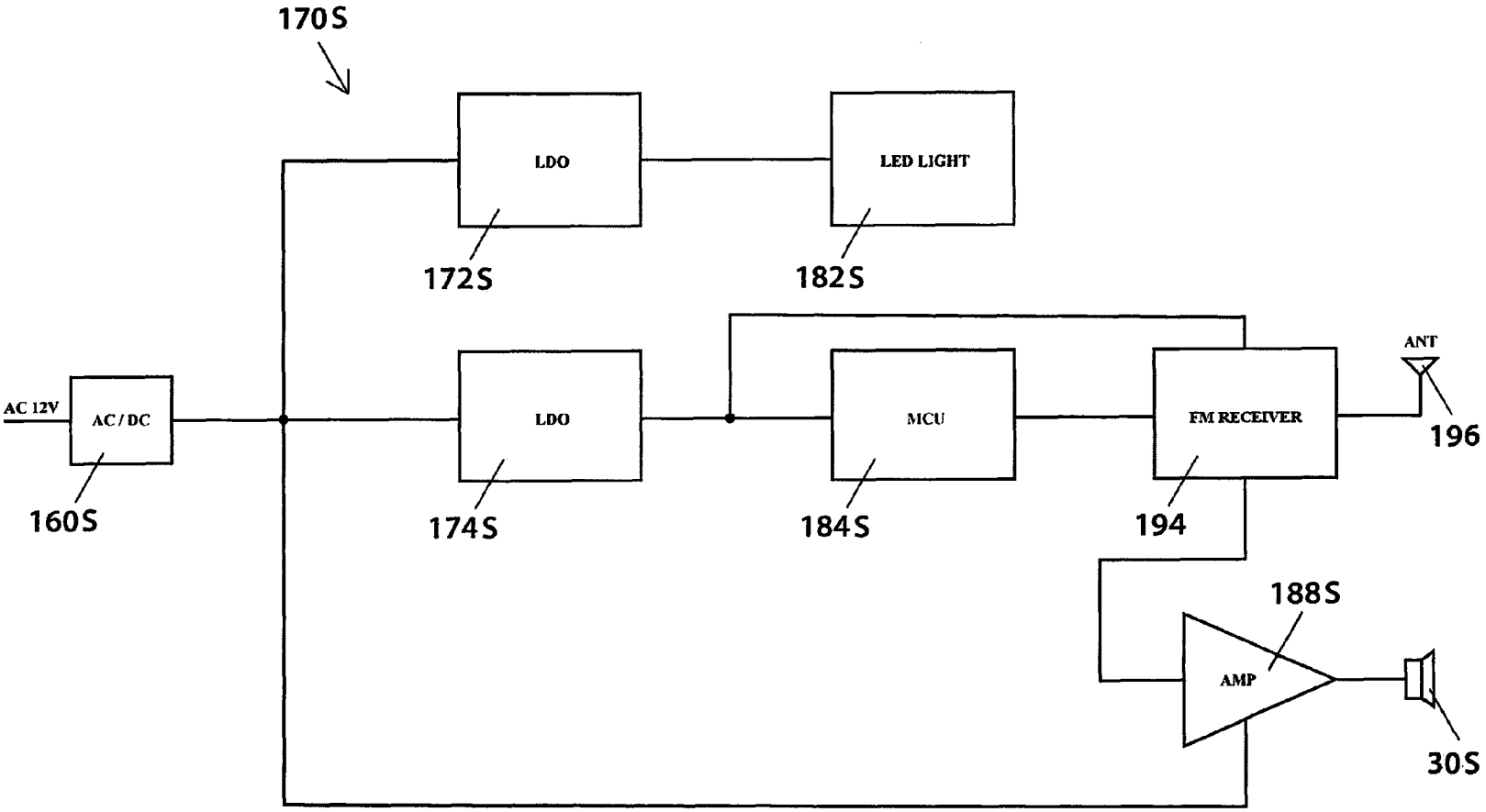
FIG. 5 is an audio light slave speaker block diagram.

FIG. 5 is a slave (secondary unit) audio light speaker block diagram. Each secondary unit can have an amplifier, FM receiver and LED light. Each secondary unit controls its' own LED light. The secondary units receive FM signals from the primary unit to play audio on the secondary speakers of the secondary unit. Audio can be played simultaneously on the speakers of the primary and secondary units. The circuits adjust for the primary and secondary units to always play audio simultaneously.

The slave (secondary) unit can work with a slave speaker 30S with the following specifications.

Slave Speaker (30S) Specifications:

Driver Rating Power: 5 W

Max Power of Slave Speaker Unit: 10 W (Includes Led)

Speaker Frequency Response: 150 Hz~20 KHz

FM Frequency: 76.5 Mhz~83.2 Mhz (4 Channels Switch Automatically)

FM Distance: ≥10 M

Pairing Time with Main Speaker: ≤30 S

Searching Main Speaker Time Limit: Within 5 Mins.

LED: 2*0.25 W

LED Light Temp: 100 Lm/W 3000K

LED Lumen ≤1 Lm (Lux) On

LED Lumen ≥20 Lm (Lux) Off

Storage Temp: −10° C.~65° C. Humidity <90%

Working Temp: −5° C.~40° C. Humidity <90%

Referring to FIGS. 1-3 and 5, for each slave unit, a power source of 12V into the circuit can be stepped down to a lower voltage for the smaller components to avoid damage to those components. The three components here can include a LED (light emitting diode), a MCU (micro controller unit chip), and a FM (frequency modulated) receiver. The LED (light emitting diode) can be a light source for the landscape light in order to illuminate a desired area. The MCU, controls the FM receiver. The FM receiver receives a FM signal.

Figure 6A:
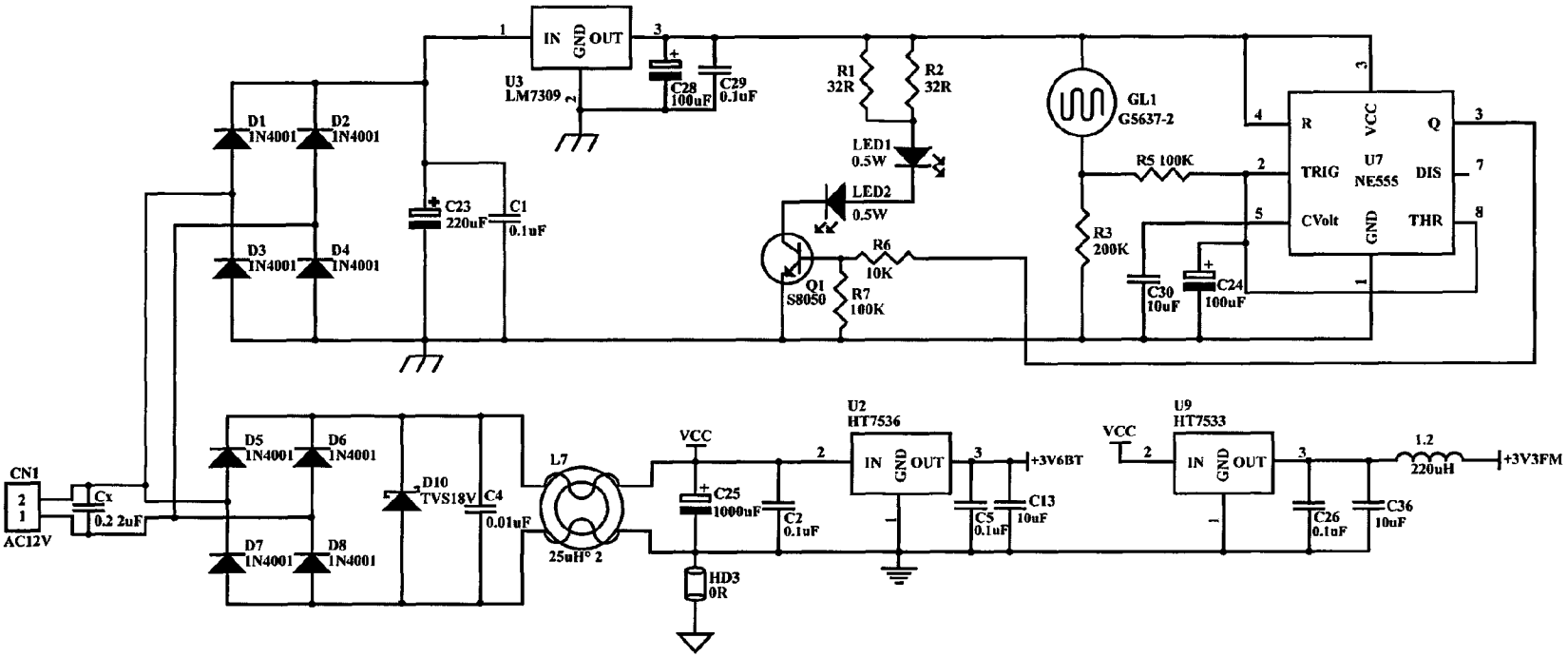
FIGS. 6A and 6B show an electronic circuit for the main speaker of FIG. 4.
Figure 6B:
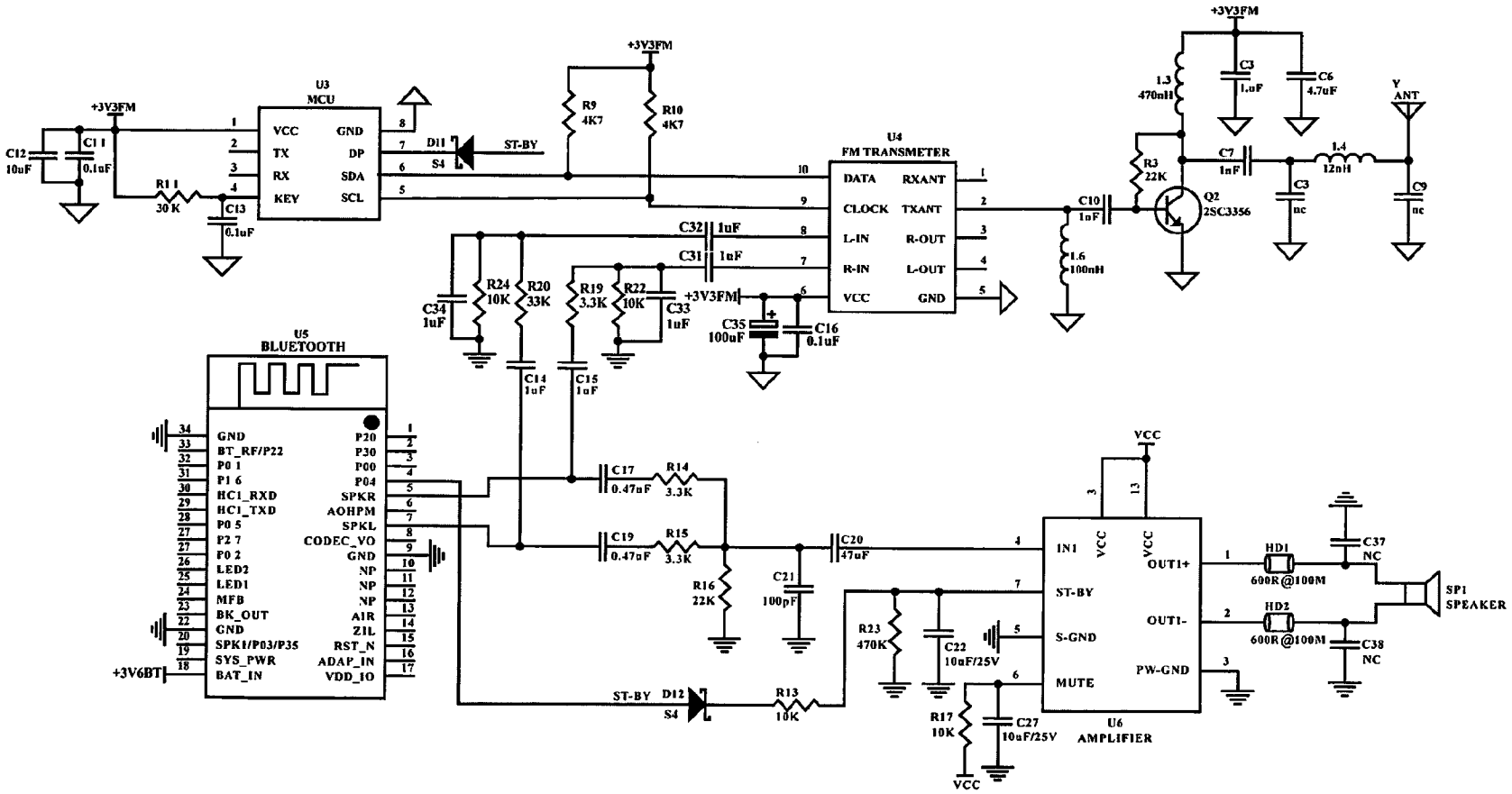

FIGS. 6A and 6B show an electronic circuit for the main speaker of FIG. 4.

Figure 7A:
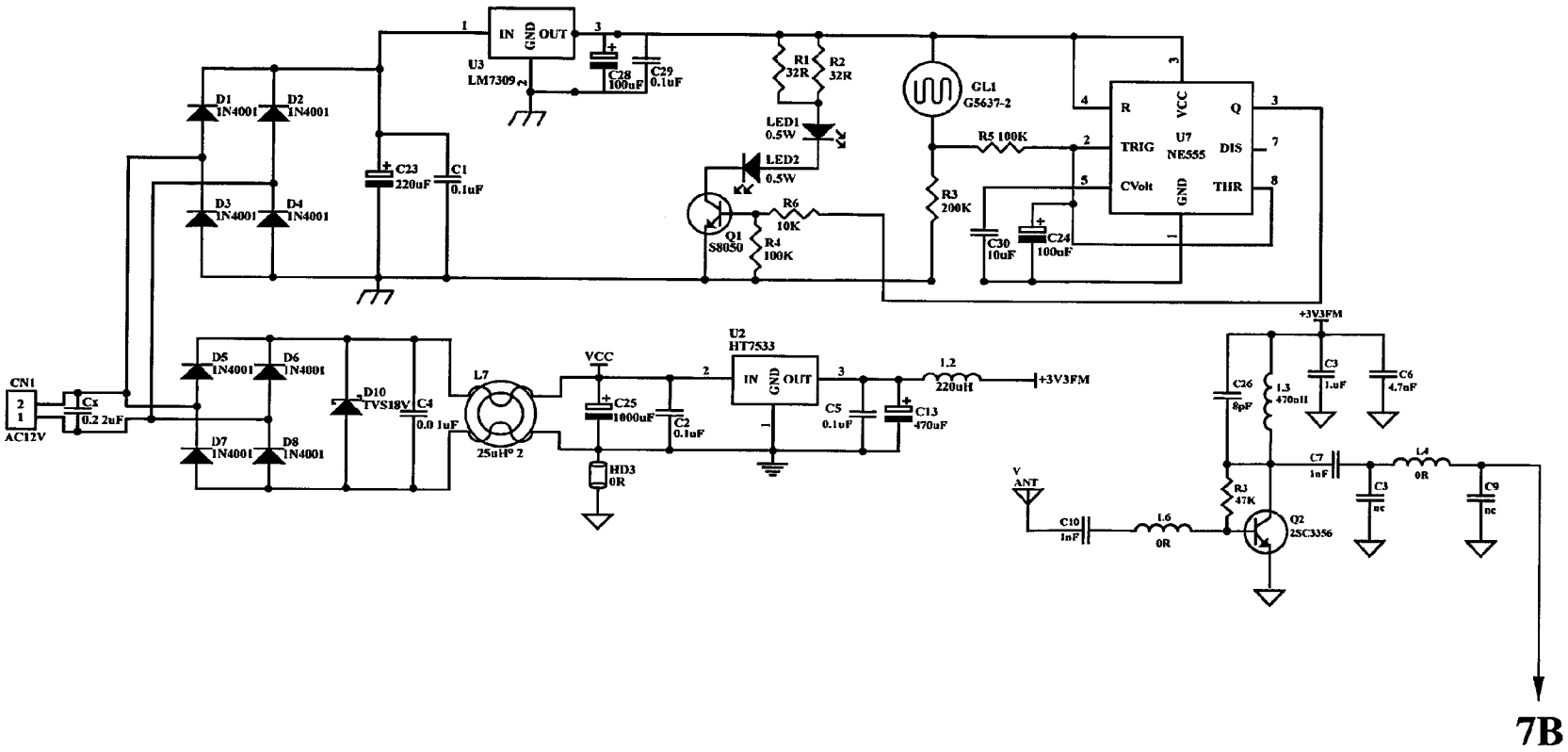
FIGS. 7A and 7B show an electronic circuit for the slave speaker of FIG. 5.
Figure 7B:
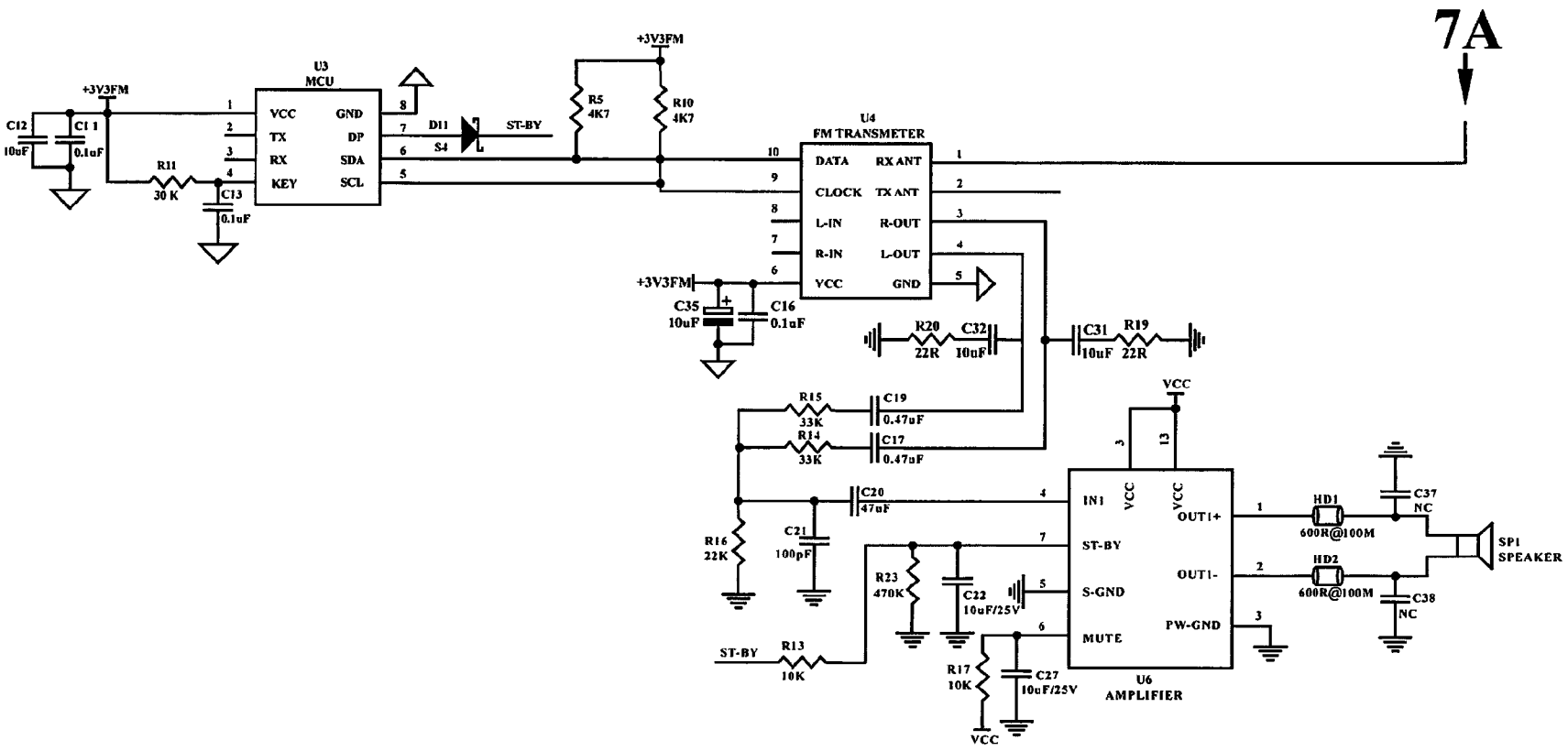

FIGS. 7A and 7B show an electronic circuit for the slave speaker of FIG. 5.

Figure 8:
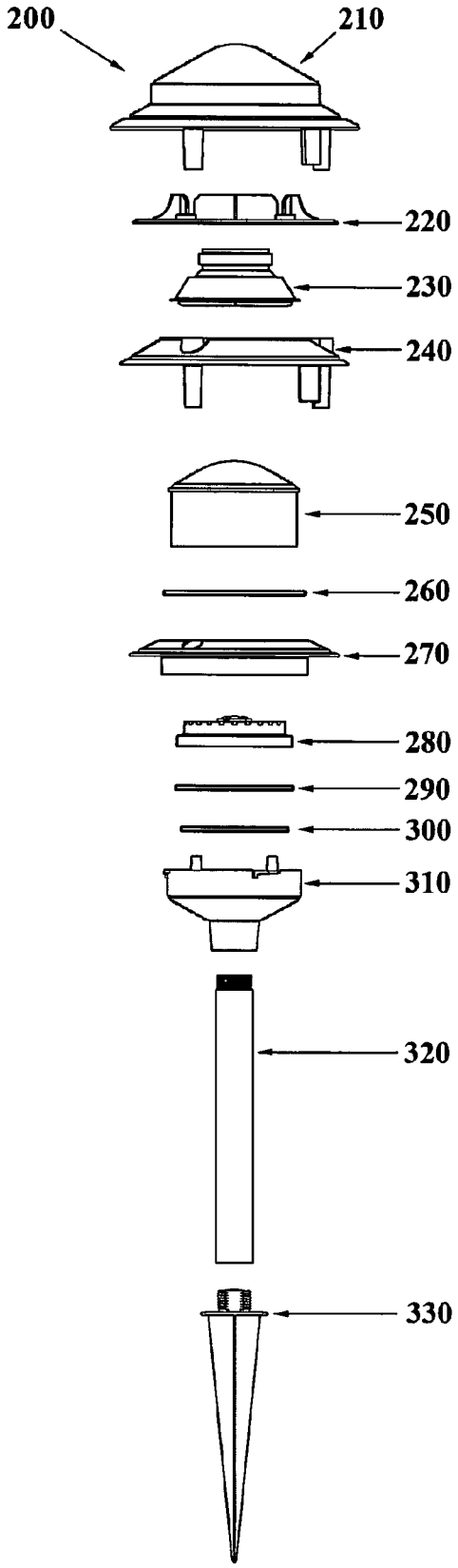
FIG. 8 is an exploded view of another single pathway/landscape light with speaker that incorporates the BLUETOOTH technology.

FIG. 8 is an exploded view of another single pathway/landscape light 200 with speaker 230 that incorporates the BLUETOOTH technology. Components 210, 220, 230, 240, 260, 270, 280, 290, 300, 310, 320 and 330 are equivalent to similar components in FIG. 1A. FIG. 8 is similar to FIG. 1A with the exception of having a modified lens 250. This lens 250 is a lower profile as compared to lens 50, gives a lower profile when assembled so that the dome portion is not visible.

Referring to FIGS. 1-8, the invention can be provided in a kit form to end-users and include low voltage (12 v DC) outdoor landscape light(s) 1 with a built-in outdoor speaker 30 which receives audio signals wirelessly through BLUETOOTH. A kit can include (6) three-tiered path lights, a single Master unit which houses the BLUETOOTH receiver (receives audio signal from any BLUETOOTH enabled device), FM transmitter (relays audio signal to Slave units), 3 Slave units which contain a FM receiver (receives audio signal from Master unit) and 2 units which only have lights (no speaker in the units).

A single primary unit, which can be a pathway (landscape) light can have a BLUETOOTH receiver and an FM transmitter, a speaker and a light (LED).

Each secondary unit can contain a pathway/landscape light and FM receivers and speaker. The invention can also include a light only unit only contains a light only.

In operation, a separate Bluetooth device can send an audio signal (music or any audio signal) to the primary (main) unit. The primary (main) unit will synchronize the incoming audio signal and send the audio signal over the FM channel to each of the secondary (slave) units. A processor chip (MCU hardware) in the primary unit can synchronize the signal in the primary unit so that the primary unit and each of the secondary units will simultaneously play the audio music at the same time.

A preferred embodiment of a kit that can form a system using the invention can include 1 primary audio light unit, and 3 secondary units, 2 light only units a 45 watt 12 volt transformer and 18 gauge power cable.

To assemble a system having a primary unit and secondary unit(s), a user can follow the steps below:

1. Connect all the units to the power cable using the connector supplied.
2. Connect the power cable to the transformer and plug into 110 v receptacle.
3. Set the transformer switch to Manual ON.
4. Turn on any BLUETOOTH enabled device, laptop computer, tablet computer, mobile digital device, smart phones, or compatible devices, or desktop computers, and the like) and search for new devices. The enabled device can send a BLUETOOTH signal to the Primary or both the Primary and Secondary units.
5. Select Audio Path Light when it appears on the list of devices. Pairing will take a few moments.
6. When prompted for a security code, enter "1235". You will need to do this once for each BLUETOOTH device. The audio light will remember previously paired devices.
7. Select any music and control volume directly from your BLUETOOTH device.

Referring to FIGS. 1-8, the invention can work as follows. The audio light's Primary (main) unit contains a BLUETOOTH receiver and FM transmitter in addition to the speaker and LED assembly. The BLUETOOTH device, once paired, will send a signal to the BLUETOOTH receiver in the Primary unit containing information such as audio content and volume. The processor (chip) onboard then synchronizes the signal to compensate for any time lag between the Primary unit and all the Secondary units. It then simultaneously plays the sound from the Primary unit's speaker and broadcasts the audio content over a fixed FM frequency or channel. The Secondary (slave) units all contain an FM receiver which then processes the signal and amplified the sound before going into the speaker. Because the signal has taken account the delay from the Primary and Secondary units, all speakers produce the sound in unison without any echo or reverberation.

The BLUETOOTH control board also contains security protocols that prevent any inadvertent pairing form devices passing by. A 4 digit code it prompts for stores each paired device within its memory. When a previously paired device is reintroduced and the audio light is not paired with anything, it will automatically connect to that device. Should there be 20 or more devices appearing simultaneously in such as scenario, the last one paired previously will be connected.

For daytime usage, all the units (primary and secondary) can be equipped with a built-in photo sensor that will allow the units to remain energized (set from the transformer) with the LED lights off.

The novel invention system and method allows for no lag time between playing music and audio signals between different units.

The novel invention system and method eliminates echo effects when playing music and audio signals between different units.

The novel invention system and method eliminates reverberation effects when playing music and audio signals between different units.

Although the preferred embodiment is described for use with pathway and landscape lights, the invention can be used as a communication system, device, apparatus, and method with other devices, such as but not limited ceiling fans, bath fans used for bath ventilation, and security alarms. Two or more ceiling fans mounted in different rooms in a residential or commercial location can each have similar BLUETOOTH transmitters/receivers and speakers so that music is played from speakers connected to the respective ceiling fans. Similarly, two or more bath fans mounted in different bathrooms in a residential or commercial location can also similarly use the invention. Using the BLUETOOTH communication between security devices to extend an audio signal to the light kit (external source).

Although the preferred embodiment uses a Bluetooth transmitter and BLUETOOTH receiver, the invention can be practiced with other protocols, such as but not limited to WiFi, Zigbee, Z-Wave, Electric Imp, 60 GHz Protocols—WirelessHD and WiGig, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. An outdoor BLUETOOTH pathway/landscape lighting system, consisting of:

a primary unit with a light and BLUETOOTH receiver which receives audio signals from a BLUETOOTH enabled device, and a transmitter, and a primary speaker, the primary unit having a primary housing consisting of three tier covers on top of a primary ground based stake; and at least one secondary unit having a secondary ground mounted light and receiver that receives audio signals from the primary transmitter, and a speaker, each secondary unit having a secondary housing consisting of three tier covers on top of a secondary ground based stake, wherein the receiver on the primary unit receives the audio signal from the BLUETOOTH enabled device and relays the audio signal by the transmitter to each receiver on each secondary unit, so that the primary speaker and each secondary speaker plays the audio signals simultaneously with no lag time between playing the audio signals between each of the primary and secondary units when used outdoors; and the primary housing and the secondary housing, each consists of a top tier cover for mounting the speaker a middle tier cover for mounting a lens and a bottom tier cover for mounting the light and a heat sink, wherein the transmitter and the receiver include an FM (frequency modulated) transmitter and FM (frequency modulated) receiver, that each have an FM frequency range consisting of between 76.5 Mhz to 83.2 Mhz, and consisting of automatic switching to 4 channels in the FM frequency range.

2. The system of claim 1, wherein each bottom tier includes an LED (light emitting diode) mounted on a cylindrical shaped heat sink.

3. The system of claim 1, wherein the primary unit and each secondary unit include:

a support mount for mounting each speaker to direct the audio signals in a downward direction, therefrom.

4. The system of claim 1, wherein the primary unit and each secondary unit include:

a micro controller chip for allowing each speaker to generate the audio signals simultaneously from the primary unit and each secondary unit.

5. A method of simultaneously playing audio signals from landscape and pathway lights mounted outdoors, consisting the steps of:

providing a primary unit having a primary light and a protocol receiver which receives audio signals from a remote protocol BLUETOOTH enabled device, and a transmitter, and a primary speaker;

providing at least one secondary unit, each having a secondary light, a receiver and a secondary speaker;

providing the primary unit and each secondary unit to each have a housing consisting of three tiers with a ground based stake extending below the housing;

providing the primary unit and the at least one secondary unit each consist of a top tier cover for mounting the primary and the secondary speaker a middle tier cover for mounting a lens and a bottom tier cover for mounting the primary and the secondary light and a heat sink;

sending a protocol generated audio signal to the protocol receiver in the primary unit and transmitting the audio signal from the transmitter to each receiver in each secondary unit;

synchronizing each speaker in the primary unit and each secondary unit to play the audio signal simultaneously with no lag time between playing the audio signals between each different unit when used outdoors;

transmitting the audio signal through a FM (frequency modulated) channel from an FM (frequency modulated) transmitter at the primary unit;

receiving the audio signal with an FM (frequency modulated) receiver at each secondary unit; and providing the FM (frequency modulated) transmitter and the FM (frequency modulated) receiver, each have a FM frequency range consisting between 76.5 Mhz to 83.2 Mhz, and consisting of automatic switching to 4 channels in the FM frequency range.

6. The method of claim 5, wherein the step of synchronizing includes the step of: providing a micro processor controller chip at the primary unit and each secondary unit.

7. The method of claim 5, wherein each bottom tier cover includes a mount for mounting an LED (light emitting diode) on a cylindrical heat sink.

8. A pathway and landscape lighting and audio generating system for use outdoors, consisting of:

a primary unit having a protocol receiver which receives audio signals from a remote protocol enabled BLUETOOTH device, with a transmitter and primary speaker, and primary light, the primary unit having a primary housing consisting of three tiers with a primary ground based stake extending below the primary housing; and at least one secondary unit having a receiver that receives audio signals from the primary transmitter, and secondary speaker, and secondary light, each secondary unit having a secondary housing consisting of three tiers with a secondary ground based stake extending below the secondary housing;

the primary housing and the at least one secondary housing, each consisting of a top tier cover for mounting the primary and the secondary speaker a middle tier cover for mounting a lens and a bottom tier cover for mounting the primary and the secondary light and a heat sink;

a single low voltage power supply for supplying a single low voltage power to the primary unit and each secondary unit, wherein the protocol receiver on the primary unit receives the audio signal from the remote protocol enabled BLUETOOTH device and relays the audio signal by the transmitter to each receiver in each secondary unit, so that the primary speaker at the primary unit, and the secondary speaker at each of the secondary units generates the audio signals simultaneously without lag time between playing the audio signals when used outdoors, wherein the primary unit transmitter is an FM (frequency modulated) transmitter that sends the audio signals over an FM channel to an FM (frequency modulated) receiver, wherein the FM (frequency modulated) transmitter and the frequency modulated receiver, each have an FM frequency range consisting of between 76.5 Mhz to 83.2 Mhz, and consisting of automatic switching to 4 channels in the FM frequency range.

9. The system of claim 8, wherein each bottom tier cover includes a mount for mounting an LED (light emitting diode) on a cylindrical heat sink.

* * * * *